US006082979A

United States Patent [19]

Friedman

[11] Patent Number: 6,082,979

[45] Date of Patent: Jul. 4, 2000

[54] AIR PUMP FOR VACUUM TOILET SYSTEMS

[75] Inventor: William J. Friedman, Wooster, Ohio

[73] Assignee: Sealand Technology, Inc., Big Prairie, Ohio

[21] Appl. No.: 08/880,542

[22] Filed: Jun. 23, 1997

[51] Int. Cl.[7] ..... F04B 39/10

[52] U.S. Cl. ..... 417/566; 4/431; 417/413.1

[58] Field of Search ..... 4/431; 417/566, 417/312, 413.1; 137/854; 92/98 R, 100

[56] References Cited

U.S. PATENT DOCUMENTS

| | | | |
|---|---|---|---|
| 1,554,076 | 9/1925 | Engstrand | 417/65 |
| 3,663,970 | 5/1972 | Drouhard, Jr. et al. . | |
| 3,727,241 | 4/1973 | Drouhard, Jr. et al. . | |
| 3,811,135 | 5/1974 | Drouhard, Jr. et al . | |
| 3,838,708 | 10/1974 | Schule | 137/854 X |
| 3,999,899 | 12/1976 | Sakai et al. | 417/471 |
| 4,357,719 | 11/1982 | Badger et al. | 4/316 |
| 4,545,735 | 10/1985 | Ims . | |
| 4,610,275 | 9/1986 | Beecher | 137/854 |
| 4,713,847 | 12/1987 | Oldfelt et al. | 4/316 |
| 4,819,279 | 4/1989 | Sigler et al. | 4/300 |
| 4,864,918 | 9/1989 | Martin | 92/98 R X |
| 4,865,631 | 9/1989 | Stroby et al. . | |
| 4,931,000 | 6/1990 | Fleming, Jr. | 417/534 |
| 5,074,763 | 12/1991 | Degremont . | |
| 5,139,655 | 8/1992 | Sigler . | |
| 5,214,807 | 6/1993 | Terve . | |
| 5,332,370 | 7/1994 | Nakayama et al. . | |
| 5,345,618 | 9/1994 | Sigler et al. . | |
| 5,408,704 | 4/1995 | Bailey et al. . | |
| 5,413,599 | 5/1995 | Imachi et al. | 137/854 X |
| 5,421,808 | 6/1995 | Osbon et al. . | |
| 5,604,938 | 2/1997 | Tyler | 4/321 |
| 5,621,924 | 4/1997 | Friedman et al. | 4/431 |
| 5,681,148 | 10/1997 | Friedman et al. | 417/36 |
| 5,732,417 | 3/1998 | Pondelicke t al. | 4/427 |

FOREIGN PATENT DOCUMENTS

| | | |
|---|---|---|
| 0584031 A2 | 2/1994 | European Pat. Off. . |
| 2 568 530 | 2/1986 | France . |
| 4228193 C1 | 10/1993 | Germany . |
| 3504766 A1 | 8/1996 | Germany . |
| 59-168257 | 9/1984 | Japan . |

OTHER PUBLICATIONS

Modern Plastics, McGraw Hill, pp. 23–30, 84–85, Oct. 1991.

Webster's New Collegiate Dictionary, p. 12, Dec. 1979.

*Primary Examiner*—Timothy S. Thorpe
*Assistant Examiner*—David J. Torrente
*Attorney, Agent, or Firm*—Nixon & Vanderhye P.C.

[57] ABSTRACT

A vacuum toilet assembly including a vacuum toilet and a vacuum tank (e.g. a combined holding and vacuum tank) uses a simple air pump to remove air from the tank to create a partial vacuum. The air pump is capable of achieving about ten inches mercury of vacuum in an empty 9.5 gallon vacuum tank in roughly one minute, and can pump at least about one liter of liquid per minute. A combined sound muffler and odor filter and/or rat-tail check valve and noise reducer, is/are connected to the outlet from the air pump. The pump comprises a powered reciprocating diaphragm pump having a reciprocating diaphragm powered by an electric motor rotating an eccentric at about 2300 rpm, and oppositely directed first and second disk valves. The disk valves have elastomeric disk valve elements die-cut from flat sheets which cooperate with perforated concave surfaces in a dividing wall in the pump housing. The reciprocating diaphragm has a total stroke length of about 0.3–0.33 inches.

18 Claims, 6 Drawing Sheets

AIR PUMP FOR VACUUM TOILET SYSTEMS

BACKGROUND AND SUMMARY OF THE INVENTION

In typical vacuum toilet assemblies, such as are used in boats and recreational vehicles, as shown by U.S. Pat. No. 5,621,924, and co-pending applications Ser. Nos. 08/551,029 filed Oct. 31, 1995 and 08/839,267 filed Apr. 17, 1997 (the disclosures of which are hereby incorporated by reference herein), the pump for creating the vacuum reservoir in an air tight tank (either a simple vacuum tank, or a combined vacuum and sewage holding tank) must be able to pump sewage waste (liquid with a large amount of solids) in addition to pumping air to create the vacuum. That means that the pump must be of fairly high quality, and typically includes a significant number of metal interior components in order to be effective. However in vacuum toilet systems associated with vehicles, such as boats and recreational vehicles, it is desirable to reduce the weight of the vacuum toilet assembly, and it is of course also desirable to make it less expensive.

According to the present invention a vacuum toilet assembly is provided, and particularly a reciprocating diaphragm air pump associated with the vacuum toilet assembly, which contains substantially all plastic or rubber internal components so that it is relatively light in weight, and relatively inexpensive. The air pump according to the invention is used solely to withdraw air from the vacuum holding tank, and is particularly desirable for use with a combined vacuum and sewage holding tank. While the pump can pass water in emergency situations without damage, it is designed specifically for use with air alone, and therefore can have a lighter construction.

The ability of the pump of the invention to pull vacuum and pump water makes it unique among commercial pumps. In practice water pumps are poor vacuum pumps and vacuum pumps are poor water pumps. The pump of the invention, however, because of its unique design (including reinforced die-cut flat elastomeric material disk valve elements, all non-metallic interior cavity, and particular stroke with optimized stroke versus performance characteristics) is an excellent vacuum pump yet unlike other good vacuum pumps will not seize if it encounters an incompressible fluid like water. The pump cavity has good vacuum efficiency yet will not be overstressed if it is necessary to pump water.

According to one aspect of the present invention a vacuum toilet assembly is provided. The assembly comprises: A vacuum toilet. A vacuum tank operatively connected to the vacuum toilet so as to provide a source of vacuum to remove waste from the toilet when the toilet is flushed. An air pump connected to the vacuum tank for removing air from the vacuum tank to create a partial vacuum therein, the air pump having an inlet conduit connected to an upper portion of the tank, and an outlet. And, a sound muffler and an odor filter operatively connected to the air pump outlet, or a sound reducing check valve.

The sound muffler and odor filter may comprise a combined muffler and filter, such as a conduit suction having activated charcoal therein. For example the muffler may keep sound emissions below 65 decibels. The muffler preferably is, for example, a 0.625 inch outside diameter tube about six inches long and filled with activated charcoal, which captures odor. The combined muffler/filter can be placed anywhere in the discharge line (e.g. hose, conduit, or the actual outlet itself) of the air pump outlet. Alternatively a rat-tail check valve is used which allows air to exit the pump, but none to enter, yet also serves as a noise suppressor. Even if foreign material fouls the main valves the check valve will prevent vacuum loss.

The vacuum tank preferably is a combined vacuum and holding tank, such as shown in pending applications Ser. Nos. 08/551,029 filed Oct. 31, 1995 and 08/839,267 filed Apr. 17, 1997 (atty. dkt. 19–125). All of the internal pump components are preferably plastic or rubber, with the exception of perhaps a fastener and diaphragm backup plate, and the pump can be mounted anywhere desirable. Using plastic for the internal pump components not only prevents rust, but reduces the weight of the pump. The pump may be mounted directly on the vacuum/holding tank, as by using a stainless steel bracket. While the pump is designed to pump only air it can pass water without damage, and operates very effectively in the humid conditions to which it is subjected.

The air pump preferably comprises a powered reciprocating diaphragm pump, having a reciprocating diaphragm. The diaphragm pump may also comprise a housing having first and second oppositely directed disk valves therein, having a first disk valve element and a second disk valve element. The diaphragm pump housing may comprise a central housing portion having the inlet and outlet therein, with a first dividing wall substantially parallel to the direction of movement of air between the inlet and the outlet. A second dividing wall may prevent direct flow of air between the inlet and the outlet. Typically the first dividing wall will be generally horizontal and the second dividing wall will be generally vertical in the standard mounting of the pump. The first dividing wall has a plurality of first perforations associated with the first disk valve element and a plurality of second perforations associated with a second disk valve element, the disk valve elements cooperating with concave perforated portions of the first dividing wall. The first dividing wall also preferably has a sealing surface engaging the reciprocating diaphragm, the sealing surface having a plurality of sealing rings thereon. The disk valve elements may be connected to the first dividing wall by canoe clips in oppositely directed blind bores formed in the first dividing wall.

Typically the reciprocating diaphragm has a total stroke length of about 0.3–0.33 inches [0.75–0.85 cm], e.g. with a 0.156 inch [0.4 cm] half-stroke or 0.312 inch [0.8 cm] full stroke, to create a vacuum and expel removed air. The pump is capable of achieving about 10 inches [25.5 cm] mercury of vacuum in an empty 9.5 gallon vacuum tank in roughly one minute, yet can pump at least about five liters of water per minute if necessary (e.g. about 7–8 l./min.). Where a combined vacuum/holding tank is provided, of course as the tank fills with sewage liquid, the amount of time for creating the necessary vacuum for it to act as a vacuum reservoir is significantly reduced.

Any suitable motor and mechanical connection may be provided for effecting reciprocation of the diaphragm. For example a direct drive 12 volt D.C. motor, typically operating at a speed of about 2100–2600 rpm, preferably about 2300 rpm (a speed giving adequate performance and relatively low sound emission, i.e. having an optimized noise versus performance ratio), may be used as the power source for powering reciprocation of the diaphragm. The diaphragm is typically of any suitable flexible material such as natural or synthetic rubber (e.g. nitrile rubber), or various plastics (such as a copolymer of polypropylene and polyethylene), and may have top and bottom stainless steel backing plates. The diaphragm and plates may be connected to a connecting rod at one end thereof, the other end of the rod having a pressed in ball bearing. Pressed into the inner race of the ball bearing may be an eccentric which creates the 0.156 inch half stroke. However any other suitable conventional mechanism may be provided for effecting the reciprocation of the diaphragm.

The central housing portion preferably has a tapered volume defined between the diaphragm and the first dividing wall. The volume has an area adjacent the first dividing wall of about 83–93% (e.g. about 88%) of the area adjacent the diaphragm when it is in a central position intermediate the end of its stroke. This increases pump efficiency, and combined with the preferred stroke length and motor rpm set forth above, provides an optimized noise/efficiency ratio.

According to another aspect of the present invention a reciprocating diaphragm air pump per se is provided. The air pump comprises the following components: A central housing portion having the inlet and outlet therein, a first dividing wall substantially parallel to the direction of movement of air directly between the inlet and outlet and having first and second opposite surfaces each having a concave portion, and a second dividing wall preventing direct flow of air between the inlet and the outlet. A first elastomeric disk valve element engaging the concave portion of the first surface, and a second elastomeric disk valve element engaging the concave portion of the second surface. The first dividing wall having a plurality of first perforations extending between the first and second surfaces and associated with the first disk valve element, and a plurality of second perforations extending between the first and second surfaces and associated with the second disk valve element. And, a powered reciprocating diaphragm movable in a direction generally perpendicular to said first and second surfaces to cause air flow through the first perforations when the diaphragm moves away from the first and second surfaces, and to cause air flow through the second perforations when the diaphragm moves toward the first and second surfaces.

The details of the reciprocating diaphragm pump are as described above with respect to the vacuum toilet assembly.

According to a still further embodiment of the present invention, a reciprocating diaphragm air pump per se is provided comprising the following components: A central housing portion having the inlet and outlet therein. First and second oppositely directed check valve elements associated with the housing portion. A powered reciprocating diaphragm movable in a first direction to cause air flow through the first check valve but not the second check valve, and in a second direction, opposite to the first direction, to cause air flow through the second check valve but not the first check valve. Wherein the air pump is capable of achieving about ten inches [25.5 cm] Hg of vacuum in an empty 9.5 gallon [38 liter] vacuum tank in roughly one minute, and it can pump more than a liter (actually more than 5 liters) of water per minute, if necessary. And, wherein the reciprocating diaphragm has a total stroke length of about 0.3–0.33 inches.

The first and second check valves are preferably oppositely directed elastomeric disk valve elements, cooperating with perforated concave surfaces. Except for drive components, substantially all of the pump components are plastic or rubber. The rest of the details of the pump may be as described above.

It is the primary object of the present invention to provide an advantageous vacuum toilet assembly, and a reciprocating diaphragm air pump for use therein. This and other objects of the invention will become clear from an inspection of the detailed description of the invention, and from the appended claims.

DETAILED DESCRIPTION OF THE DRAWINGS

Figure 1:
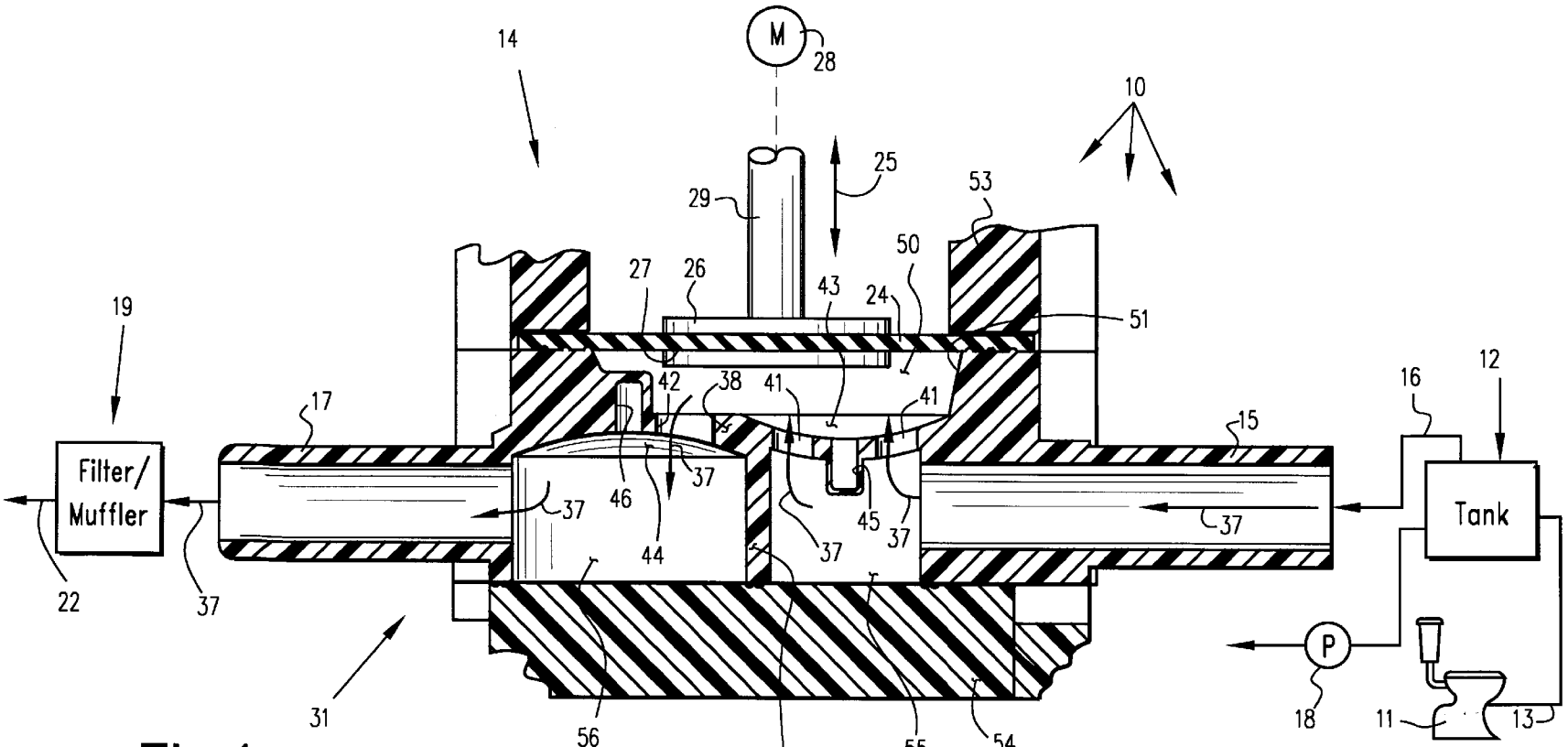
FIG. 1 is a side view of a vacuum toilet assembly according to the present invention showing the air pump in detail and in cross-section (with the disk valve elements removed for clarity of illustration), and showing the rest of the components schematically.

The preferred embodiment of a vacuum toilet assembly according to the present invention is shown generally by reference numeral 10 in FIG. 1. The assembly 10 includes a conventional vacuum toilet 11, and a combined vacuum and holding tank 12 which is operatively connected, via line 13, to the toilet 11 so as to provide a source of vacuum to remove waste from the toilet 11 when the toilet is flushed. The tank 12 may be associated with more than one toilet and may have any suitable configuration, such as shown in pending applications Ser. Nos. 08/551,029 filed Oct. 31, 1995 and 08/839,267 filed Apr. 17, 1997 (the disclosures of which are incorporated by reference herein).

An air pump, shown generally by reference numeral 14, is connected to the vacuum tank 12 for removing air from the tank 12 to create a partial vacuum therein. The air pump has an inlet conduit 15 connected to an upper portion of the tank 12, as by the line 16 schematically illustrated in FIG. 1, and an outlet 17. The pump 14 may be positioned any place where desired, such as mounted by a mounting bracket (such as a stainless steel mounting bracket) directly on the top of the tank 12. Conventional tank internal baffles may be provided at the connection to the line 16.

The assembly 10 may also desirably include a pump 18 for pumping sewage out of the tank 12 when desired. The pump 18 may either be directly mounted with the assembly 10, or may be located at a pump out facility.

The assembly 10 may further comprise a sound muffler and an odor filter operatively connected to the outlet 17. The muffler and odor filter are illustrated schematically at 19 in FIG. 1. They may be separate components utilizing conventional materials for muffling the sound and removing odors. However, the preferred form that the muffler/filter 19 may take is shown in more detail in FIG. 2, there comprising a combined muffler and filter including a conduit section 20 having activated charcoal 21 therein. For example the conduit 20 may be a 0.625 inch [1.6 cm] outside diameter tube about six inches [15 cm] long and filled with activated charcoal 21, e.g. having holding screens (not shown) at the ends of the tube for holding the charcoal 21 in place, generally as shown in the odor filter for U.S. Pat. No. 5,139,655. The conduit 20 may be located any place desired in the discharge from the pump 14, e.g. connected directly to the outlet 17, or connected by a flexible hose to the outlet 17 and positioned at a desirable place so that the discharge 22 from the muffler/filter 19 is vented outside the boat, recreational vehicle, or the like in which the entire assembly 10 is mounted.

Figure 9:
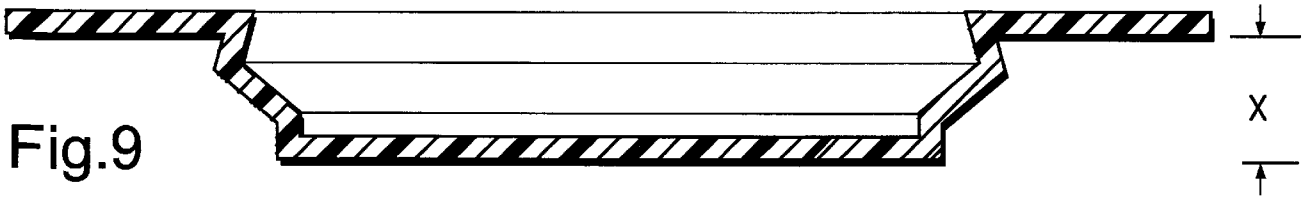
FIG. 9 is a side cross-sectional view of an exemplary plastic diaphragm that may be used in the pump according to the invention.

The pump 14 preferably comprises a powered reciprocating diaphragm pump having a reciprocating diaphragm 24 as seen in FIG. 1, and reciprocating in the dimension 25 illustrated therein. The diaphragm 24 is preferably of rubber, synthetic rubber, or a suitable plastic, and in the preferred embodiment illustrated in FIG. 1 has upper and lower stainless steel plates 26, 27, respectively mounted at a central portion thereof to back up the diaphragm 24. One form that a plastic diaphragm could take according to the invention is illustrated at 24' in FIG. 9. The preferred plastic for this configuration is a copolymer of polypropylene and polyethylene, but other plastics may also be used. The diaphragm 24' has more resistance to odor penetration, and will have greater cycle life, than comparable nitrile rubber diaphragms. The diaphragm 24' may have a diameter of about three inches [7.6 cm] and a dimension X of about 0.358 inches [0.91 cm], having a contoured central portion resembling a bellows section as illustrated in FIG. 9. Thus the contoured central portion extends outwardly from the plane containing the diaphragm 24' a distance (X) greater than the stroke length (e.g. about 0.312 inches) of the diaphragm.

The actual mechanism for reciprocating the diaphragm 24, 24' in the dimension 25 may be any suitable conventional mechanism, which may include a direct drive 12 volt D.C. motor 28, e.g. running at a speed of about 2100–2660 rpm, desirably about 2200–2400 rpm, and preferably about 2300 rpm. That speed provides an optimized performance and sound emission ratio. A connecting rod 29 connected to the motor 28 may be provided. One exemplary mechanism that may be provided is to effect reciprocation of the diaphragm 24 and plates 26, 25 will be described with respect to FIG. 5.

In the preferred embodiment the diaphragm 24 has a total stroke length of between about 0.3–0.32 inches, e.g. a 0.156 half stroke length (that is moving 0.156 inches in the dimension 25 both above, and below, the position illustrated in FIG. 1), or a total full stroke length of 0.313 inches. This is sufficient to create a suitable vacuum in a suitably short period of time. For example where the tank 12 has an interior volume of about 9.5 gallons, a suitable degree of vacuum—which is typically about ten inches of Hg—may be established in the tank 12 by operating the pump 14 for roughly about one minute. As the tank 12 fills with sewage the amount of air in the tank above the sewage has a reduced volume, and therefore the time to establish the appropriate level of vacuum in the tank 12 is reduced as the tank 12 fills. The unique ability of the pump 14 to pump water means that it can pump at least a liter of water per minute if necessary, typically at least about five liters per minute (e.g. about 7–8 l./min.).

Any suitable conventional sensors or controls may be provided associated with the tank 12 to indicate when it is full, or reaching full, or to operate the pump 18 to empty the tank automatically once it reaches a certain level full, or to prevent operation of the motor 28. However should any water be drawn into the pump 14, even though that is not what it is designed for, the water can pass through the pump 14 without damaging the pump, especially since the interior components are plastic or rubber.

Figure 2:
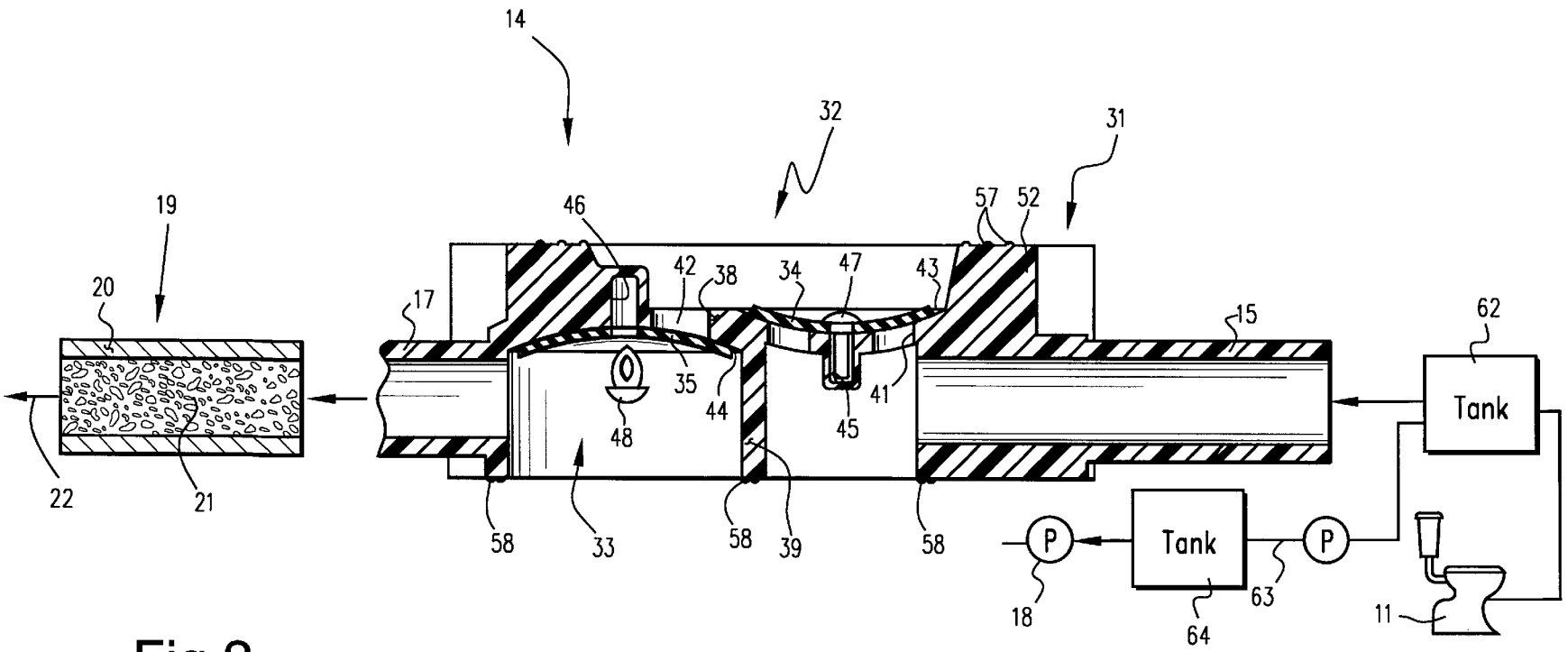
FIG. 2 is a view like that of FIG. 1 only showing the muffler/filter in more detail, and a different embodiment of the various vacuum components, and showing the disk valve elements in the air pump, and the manner of mounting thereof in the air pump.

Diaphragm pump 14 preferably comprises a central housing section 31 (seen per se in FIG. 2) having first and second oppositely directed disk valves (acting as check valves) therein, as shown generally by reference numerals 32 and 33 in FIG. 2, and having a first valve disk element 34 and a second valve disk element 35. The valve disk elements 34, 35 in response to fluid pressure [elements 34, 35 are not shown in FIG. 1 for clarity of illustration, i.e. so that the air flow—as illustrated by arrows 37—may be readily illustrated therein].

Figure 3:
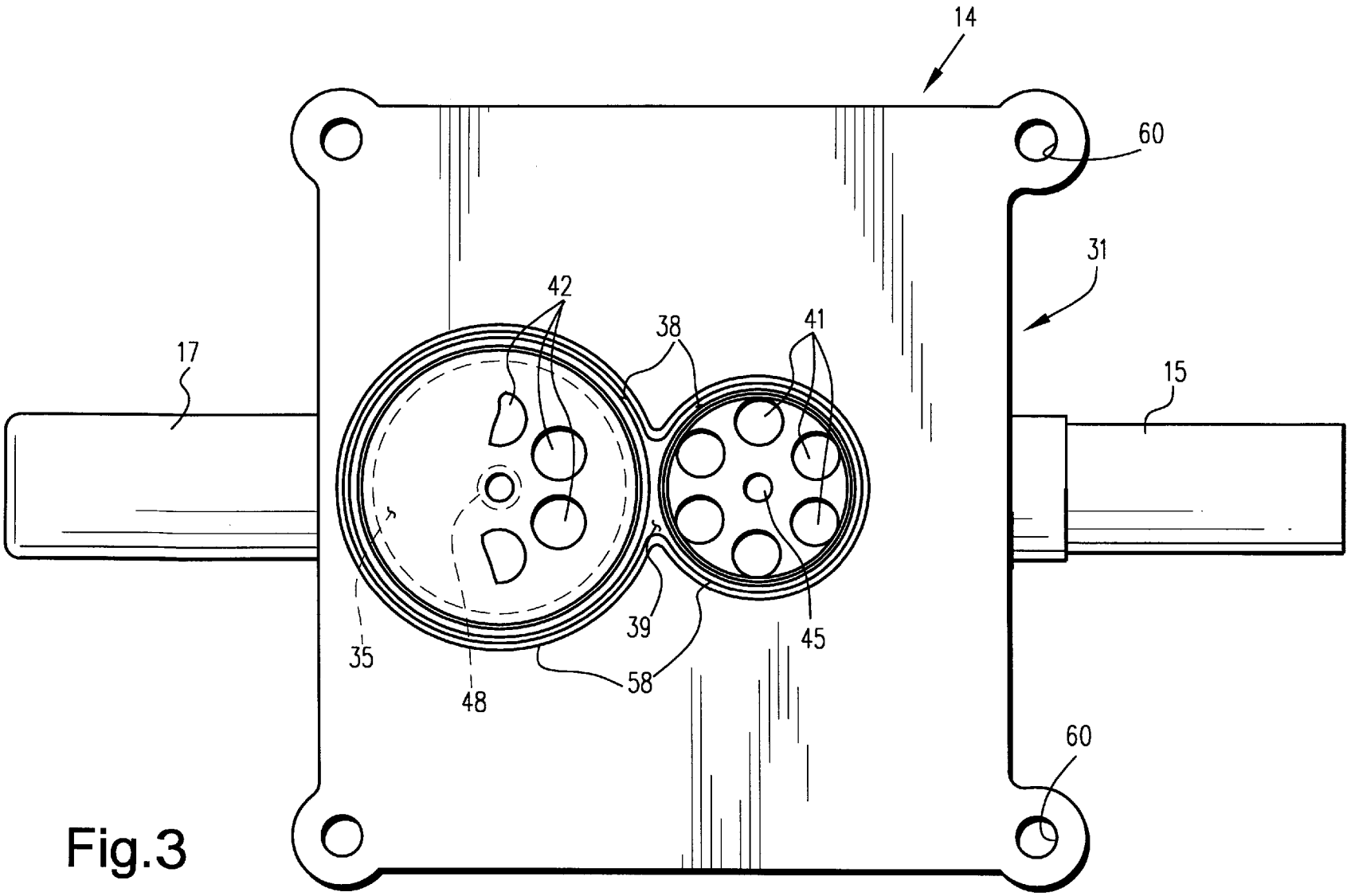
FIG. 3 is a bottom plan view of the pump housing with the valve disk element shown in dotted line, per se, of FIG. 2.

The central portion 31 of the housing for the pump 14 has the inlet 15 and outlet 17 therein and includes a first dividing wall 38 substantially parallel to the direction of air movement directly between the inlet 15 and the outlet 17, and a second dividing wall 39 (see each of FIGS. 1 through 3) preventing direct flow of air between the inlet 15 and the outlet 17. Wall 38 may be generally horizontal and wall 39 generally vertical.

Figure 4:
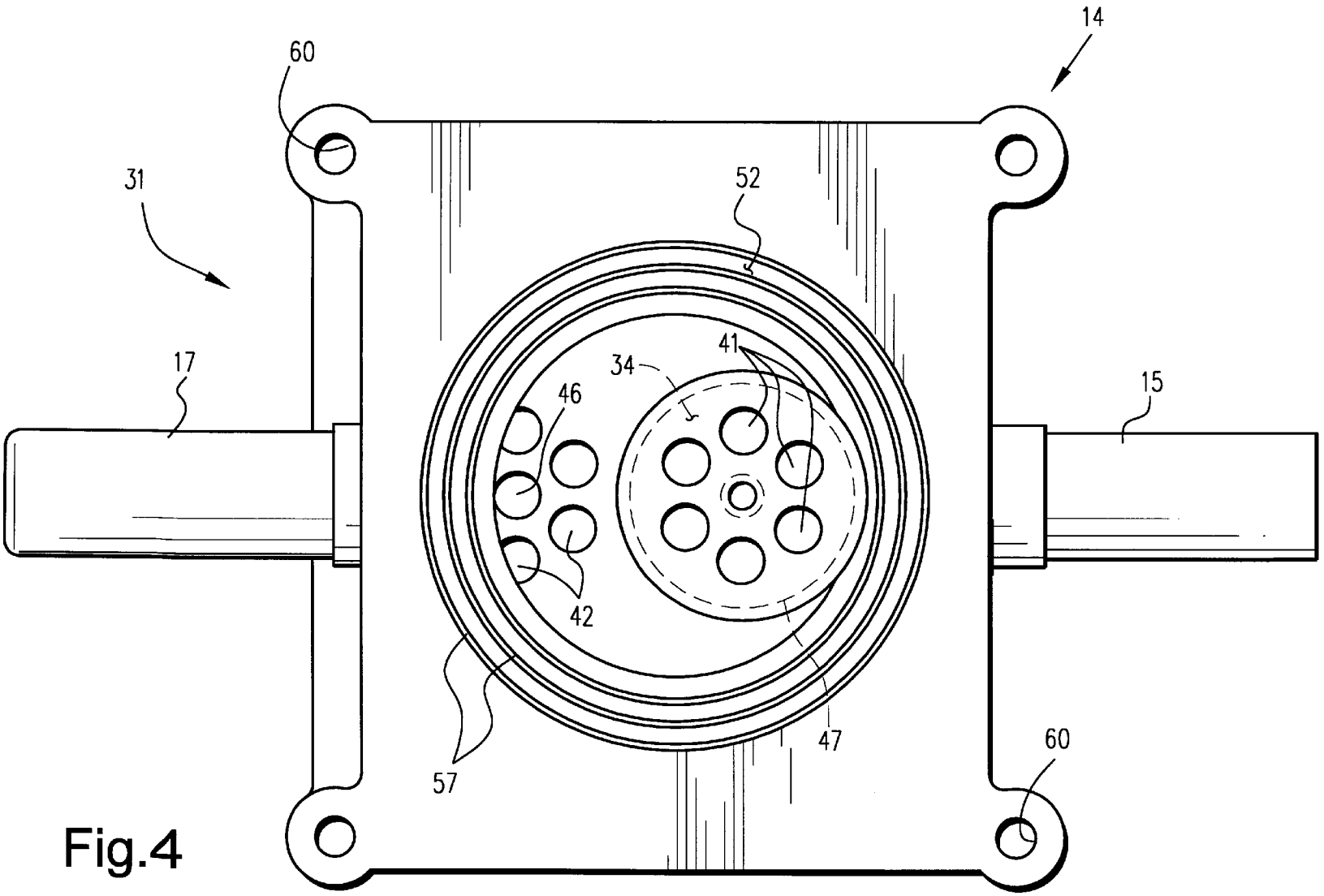
FIG. 4 is a top plan view of the pump housing component of FIG. 2 with the valve disk element shown in dotted line.

The first dividing wall 38 has a plurality of first perforation 41 therein extending through the first dividing wall 38 from one surface thereof to the other, and a second plurality of perforations 42 also extending from one face to the other and associated with the disk valve element 35. The perforations 41—as seen most clearly in FIGS. 1 and 2—are associated with a concave "upper" surface 43 of the wall 38, and perforations 42 associated with a "lower" concave surface 44 of the wall 38. Associated with the concave wall portions 43, 44 are oppositely directed blind bores 45, 46 formed in the dividing wall 38. The disk elements 34, 35 are connected to the first dividing wall 38 by conventional plastic canoe clips, 47, 48—as seen most clearly in FIG. 2, but the heads of which are shown in dotted line in FIGS. 3 and 4, respectively—to hold the disk elements 34, 35 in positions in which they releasably cover and block flow through the perforations 41, 42, respectively.

For the specific embodiment illustrated in the drawings, the valve disks 34, 35 are preferably circular pieces of elastomeric material, such as synthetic rubber, having a diameter of about 1.25 inches [3.2 cm], and a thickness of about 0.031 inches [0.079 cm]. The disks 34, 35 are preferably reinforced die-cut flat elastomeric material (plastic or rubber) disks rather than compression molded valves. Given this construction, when the diaphragm 24 moves upwardly from the position illustrated in FIG. 1 a half stroke, a vacuum is created in the chamber 50 (see FIG. 1) which causes air to move through the perforations 41, deflecting the disk element 34, and moving into the chamber 50, while the vacuum pulls the disk element 35 against the concave wall portion 44 to seal the perforations 42 so that no air may pass therethrough. When the diaphragm 24 reaches the top of its stroke in the dimension 25 and then moves downwardly to the bottom of its stroke, pressure is created in the volume 50 which forces air to pass through the perforations 42 past the valve disk element 35 (deflecting it), and at the same time to push the valve disk element 34 into sealing arrangement with the concave wall portion 43 so that no air can pass through the perforations 41.

Also it is desirable that the volume 50 be formed with a taper. For example the annular wall 51 (see FIG. 1) defines the volume 50 so that it has an upper diameter (as seen in FIG. 1 at an intermediate position of the diaphragm 24 in a central position intermediate the ends of its stroke) of about 2.125 inches [5.4 cm] and a lower diameter dust above concave wall portion 43) of about 1.875 inches [4.75 cm]. That is the percentage of area reduction from the top to the bottom of the volume 50 is about 83–93%, e.g. about 88%. This taper 51 increases pump efficiency, and when combined with the preferred stroke length of about 0.312 inches and preferred motor rpm of about 2300, results in an optimized efficiency/noise ratio.

FIG. 1 also illustrates other exemplary housing components associated with the component 31 to seal off the various volumes within the pump 14. The peripheral portions of the diaphragm 24 are clamped between the top surface 52 (see FIGS. 2 and 4 in particular) of the central housing section 31 and an upper housing section 53 (see FIG. 1) of any suitable configuration. A bottom section 54 closes off the bottoms of the volumes 55, 56 (see FIG. 1) on opposite sides of the second dividing wall 39. The volumes 55, 56 cooperate, respectively, with the inlet 15 and the outlet 17.

Preferably the top surface 52 has a plurality of concentric sealing rings 57 (see FIGS. 2 and 4) which extend upwardly from the surface 52. For example the rings 57 may be 0.030 inches [0.078 cm] wide, 0.015 inches [0.039 cm] high, and radially spaced from each other on a common center 0.125 inches [0.32 cm]. Similar sealing rings 58 (see FIGS. 2 and 3) may also be provided on the bottom surface of the housing section 31 for cooperation with an elastomeric sealing ring (not shown) between the bottom housing section 54 and the central housing section 31.

While the housing sections 53, 31, 54 may be held together in any suitable manner, they may be connected together by metal or plastic fasteners (such as bolts and nuts) which are associated with the opening 60 (see FIGS. 3 and 4) in the housing section 31, and like openings (not shown) in the section 53, 54.

The air pump 14 according to the invention may be connected to other components of a vacuum tank assembly aside from the components of the assembly 10 illustrated in FIG. 1. For example, schematically illustrated in FIG. 2, the inlet 15 may be connected to a tank 62 that serves only as a vacuum reservoir. The tank 62 is connected, including by a pump 63, to a separate holding tank 64, or other suitable conventional components may be provided such as illustrated in U.S. Pat. No. 5,621,924 (the disclosure of which is hereby incorporated by reference herein).

In a conventional manner of use of the assembly 10 according to the present invention, when the assembly 10 is initially connected up, or after the combined vacuum/holding tank 12 has been substantially emptied by the pump 18, using conventional manual or automatic controls the motor 28 is activated so as to reciprocate the connecting rod 29 in the dimension 25. This causes the diaphragm 24 to move up and down, alternately causing air to be withdrawn from the tank 12 through the conduit 16 into the inlet 15, and to pass—as illustrated by arrows 37—through the perforations 41 into the chamber 50 while the valve disk element 35 seals the perforations 42, then to be expelled by the downward movement of the diaphragm 24 through its stroke length of about 0.313 inches by passing—as illustrated by arrows 37—out the perforations 42 while the valve disk element 34 seals the perforations 41. The air then flows through the outlet 17 through the combined muffler/odor filter 19 so that the sound is typically kept under 65 decibels and the majority of the odors are captured by the activated charcoal 21.

After the motor 28 of the pump 14 has run long enough to draw the desired vacuum in the tank 12 (e.g. eight to twelve inches [20 cm–30 cm], preferably about ten inches [25.5 cm], Hg), the motor 28 is automatically shut off (by conventional sensors and controls). When the toilet 11 is flushed, the vacuum in the tank 12 draws the sewage through the conduit 13 into the tank 12. If it is necessary to reestablish the desired level of vacuum, then the motor 28 is again automatically actuated to reciprocate the diaphragm 24 so that the desired level of vacuum is restored to the tank 12.

Substantially all of the internal components of the pump 14 are of plastic, rubber, or other non-metal. For example the entire housing section 31 may be molded as a single piece of plastic, such as ABS or polypropylene, or nylon. The canoe clips 47, 48 also are preferably plastic as are the housing sections 53, 54. The valve disks 34, 35 are of elastomeric material, as is the diaphragm 24. Typically only the plates 26, 27, and various drive components such as fasteners and ball bearings, are of metal, and perhaps the bolts passing through the opening 60 to hold the housing sections 53, 31, 54 together. In this way the weight and cost of the air pump 14 can be minimized, as well as ensuring corrosion protection should liquid be inadvertently drawn into the pump 14, or moisture condense therein.

Figure 5:
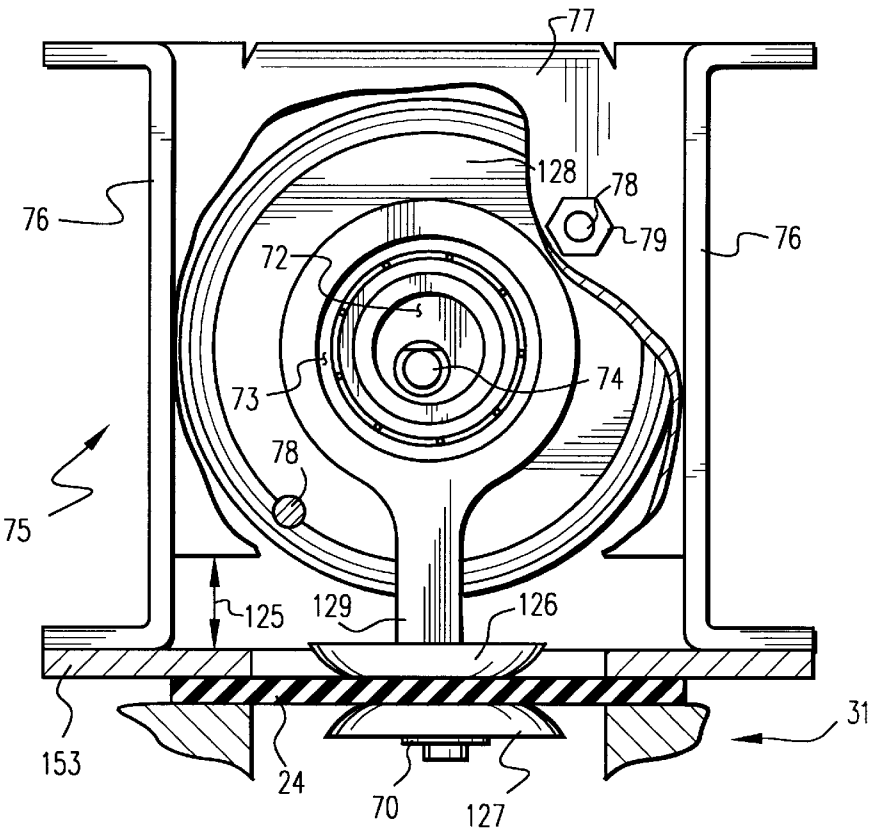
FIG. 5 is a view like that of FIG. 1 only showing the details of an exemplary drive for the pump, and modified forms of pump components.

FIG. 5 is a schematic illustration of one exemplary form that the diaphragm pump reciprocating mechanism—shown only schematically in FIG. 1—may take. In FIG. 5 components identical to those in the FIGS. 1 through 4 embodiment are shown by the same reference numeral, while structures similar but not identical are shown by the same two digit reference numeral only preceded by a "1 ".

In the FIG. 5 embodiment, the connecting rod 129 terminates with the threaded end which is received by the nut 70, and the backup plates 126, 127 preferably have a dish shape as illustrated. The connecting rod 129 is ring-shaped at the top as clearly seen in FIG. 5, and includes therein two ball bearing races or like components, such as the inner race 72 and the outer race 73, with conventional steel ball bearings (not shown) between them. Pressed into the inner race 72 is the eccentric 74, which is preferably directly connected (or by a gear reducer under some circumstances) to the drive shaft for the motor 128. Motor 128 preferably comprises a direct drive 12 volt D.C. motor operating at a speed of about 2300 rpm.

The motor 128 is mounted by a mounting bracket 75 including vertical side walls 76 and a back wall 77, the side walls 76, and perhaps also the back wall 77, being welded or otherwise attached to the housing portion 153 (which in this embodiment is metal). The motor 128 may be mounted in the bracket back wall 77 by bolts 78 which are integral with the motor 128 housing, and by nuts 79 cooperating with the bolts 78 on the opposite side of the wall 77 from the motor 128.

Figure 7:
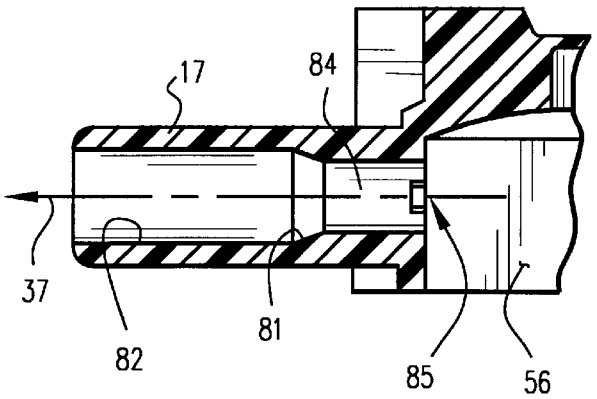
FIG. 7 is a view like that of FIG. 6 with the valve element removed.
Figure 6:
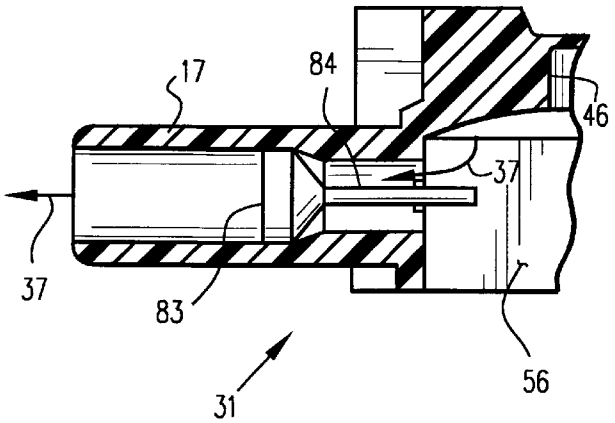
FIG. 6 is a detailed side view, partly in cross-section and partly in elevation, showing a rat-tail check valve in the pump discharge.
Figure 8:
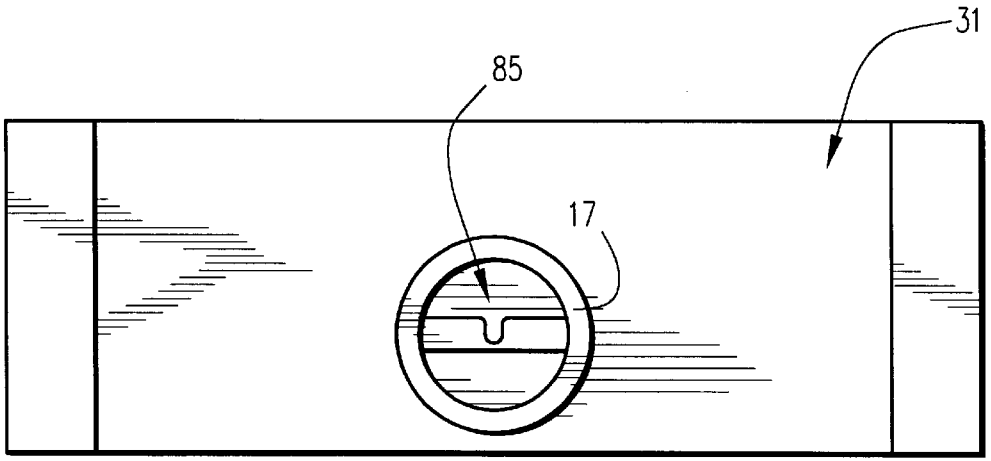
FIG. 8 is an end view of the valve housing of the FIGS. 6 and 7 embodiment.

In the embodiment of FIGS. 6–8, instead of (or in addition to) the filter/muffler 19, a means is provided to prevent loss of vacuum even if foreign material fouls the valve elements 34, 35, and to provide some noise reduction. The outlet 17 from the main housing section 31 is formed with a conical valve seat 81 in the interior 82 thereof (see FIG. 7) for receipt of a conical "rat-tail" check valve element 83. The element 83 preferably is of elastomeric material which will deflect sufficiently to allow air to move from volume 56 to the exterior of housing section 31, as indicated by arrows 37. However, the higher air pressure outside the housing section 31 forces the element 83 into contact with the seat 81 to prevent loss of vacuum, thus functioning as a backup check valve. Also the element 83 is a noise reducer, providing some noise suppression (typically at least about three decibels in the range in which it typically operates). Preferably the element 83 is held inn place by a stem 84 (FIG. 6) received within a valve retainer 85 (see FIG. 8 in particular).

It will thus be seen that according to the present invention a highly advantageous vacuum toilet assembly, as well as a reciprocating diaphragm air pump associated therewith, have been provided. While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent structures and devices.

What is claimed is:

1. A vacuum toilet assembly comprising:

a vacuum toilet;

a vacuum tank operatively connected to said vacuum toilet so as to provide a source of vacuum to remove waste from said toilet when said toilet is flushed;

an air pump connected to said vacuum tank for removing air from said vacuum tank to create a partial vacuum therein, said air pump having an inlet conduit connected to an upper portion of said tank, and an outlet; a central housing portion having said inlet and outlet therein, a first dividing wall substantially parallel to the direction of movement of air directly between said inlet and outlet and having first and second opposite surfaces each having a concave portion, and a second dividing wall preventing direct flow of air between said inlet and said outlet; a first elastomeric disk valve element engaging said concave portion of said first surface, and a second elastomeric disk valve element engaging said concave portion of said second surface; said first dividing wall having a plurality of first perforations extending between said first and second surfaces and associated with said first disk valve element, and a plurality of second perforations extending between said first and second surfaces and associated with said second disk valve element; a powered reciprocating diaphragm movable in a direction generally perpendicular to said first and second surfaces to cause air flow through said first perforations when said diaphragm moves away from said first and second surfaces, and to cause air flow through said second perforations when said diaphragm moves toward said first and second surfaces; and wherein said central housing portion has a tapered volume defined between said diaphragm and said first dividing wall, said volume having an area adjacent said first dividing wall of about 83–93% of the area adjacent said diaphragm when in a central portion intermediate the ends of its stroke; and at least one of a sound muffler and an odor filter, and a check valve and noise reducer, operatively connected to said air pump outlet.

2. A vacuum toilet assembly as recited in claim 1 wherein said reciprocating diaphragm has a total stroke length of about 0.3–0.33 inches.

3. A vacuum toilet assembly as recited in claim 1 wherein said vacuum tank comprises a combined vacuum and holding tank.

4. A vacuum toilet assembly as recited in claim 1 wherein said disk valve elements are connected to said first dividing wall by canoe clips in oppositely directed blind bores formed in said first dividing wall, and wherein said valve elements are die-cut from flat sheets.

5. A vacuum toilet assembly as recited in claim 1 wherein said air pump includes a motor rotating at a speed of about 2100–2600 rpm during operation to effect reciprocation of said diaphragm.

6. A vacuum toilet assembly as recited in claim 1 wherein a muffler and filter is provided, and wherein said muffler and filter comprise a combined muffler and filter including a conduit section having activated charcoal therein.

7. A vacuum toilet assembly as recited in claim 1 wherein said air pump is capable of pumping water, and wherein substantially all of said pump interior components are plastic or rubber.

8. A vacuum toilet assembly as recited in claim 7 wherein said air pump is capable of achieving about ten inches Hg of vacuum in an empty 9.5 gallon vacuum tank in roughly one minute, and can pump at least about five liters of water per minute.

9. A vacuum toilet assembly as recited in claim 1 wherein a check valve and noise reducer is provided, and wherein said check valve and noise reducer comprises a rat-tail elastomeric material valve element mounted in a conical seat to provide noise-reduced exit of fluid from said air pump, and to prevent entry of air into said air pump through said outlet.

10. A vacuum toilet assembly as recited in claim 1 wherein said disk valve elements are die-cut from flat reinforced elastomeric material sheets.

11. A vacuum toilet assembly as recited in claim 1 wherein said air pump is capable of achieving about ten inches Hg of vacuum in an empty 9.5 gallon vacuum tank in roughly one minute.

12. A vacuum toilet assembly as recited in claim 1 wherein substantially all of said pump interior components are plastic or rubber, and wherein said pump can pump at least about five liters of water per minute.

13. A vacuum toilet assembly as recited in claim 1 herein said diaphragm is plastic and has greater resistance to odor penetration and greater cycle life than a comparable nitrile rubber diaphragm.

14. A vacuum toilet assembly as recited in claim 13 wherein the plastic of said diaphragm is a copolymer of polypropylene and polyethylene.

15. A vacuum toilet assembly comprising:

a vacuum toilet;

a vacuum tank operatively connected to said vacuum toilet so as to provide a source of vacuum to remove waste from said toilet when said toilet is flushed;

an air pump connected to said vacuum tank for removing air from said vacuum tank to create a partial vacuum therein, said air pump having an inlet conduit connected to an upper portion of said tank, and an outlet; and at least one of a sound muffler and an odor filter, and a check valve and noise reducer, operatively connected to said air pump outlet; and wherein said air pump further comprises: a central housing portion having said inlet and outlet therein; first and second oppositely directed check valve elements associated with said housing portion; a powered reciprocating diaphragm reciprocal in a first direction a given stroke length to cause air flow through said first check valve but not said second check valve, and in a second direction, opposite to said first direction, to cause air flow through said second check valve but not said first check valve; wherein said diaphragm is of plastic having a greater resistance to odor penetration, and greater cycle life, than a comparable nitrile rubber diaphragm; wherein said diaphragm has a contoured central portion resembling a bellows section extending outwardly from a plane containing said diaphragm; and wherein said central portion extends outwardly from said plane a distance greater than the stroke length of said diaphragm.

16. A vacuum toilet assembly as recited in claim 15 wherein said plastic of said diaphragm is a copolymer of polypropylene and polyethylene.

17. A vacuum toilet assembly as recited in claim 15 wherein said reciprocating diaphragm has a total stroke length of about 0.3–0.33 inches.

18. A vacuum toilet assembly as recited in claim 17 wherein said air pump includes a motor rotating at a speed of about 2100–2600 rpm during operation to effect reciprocation of said diaphragm.

* * * * *